US005950881A

United States Patent [19]

Sherman et al.

[11] Patent Number: 5,950,881

[45] Date of Patent: Sep. 14, 1999

[54] SELF-CLOSING POWDER CAP

[75] Inventors: Adam Sherman, Larchmont, N.Y.; Jonathan T. Thayer, N. Bergen, N.J.

[73] Assignee: E-L Management, New York, N.Y.

[21] Appl. No.: 09/095,395

[22] Filed: Jun. 10, 1998

[51] Int. Cl.[6] ..... B67D 3/00

[52] U.S. Cl. ..... 222/511; 222/517; 222/558; 222/512; 222/559

[58] Field of Search ..... 222/511, 512, 222/513, 517, 558, 559, 556, 560, 561

[56] References Cited

U.S. PATENT DOCUMENTS

| | | | |
|---|---|---|---|
| 2,025,188 | 12/1935 | Wilson | 222/511 |
| 2,330,939 | 10/1943 | Wilson | 222/511 |
| 2,590,437 | 3/1952 | Maves | 222/511 |
| 2,620,098 | 12/1952 | Kinley | 222/511 |
| 4,458,818 | 7/1984 | Hansen | 215/32 |
| 5,310,081 | 5/1994 | McCabe | 220/715 |
| 5,339,993 | 8/1994 | Groya et al. | 222/153 |

FOREIGN PATENT DOCUMENTS

| | | | |
|---|---|---|---|
| 2459762 | 2/1981 | France | 222/558 |

*Primary Examiner*—Andres Kashnikow
*Assistant Examiner*—Jorge Bocanegra
*Attorney, Agent, or Firm*—Kenyon & Kenyon

[57] ABSTRACT

A self-closing cap comprising a base having one or more holes and a lid movably mounted about the base. The lid has one or more holes, and is capable of occupying a first open position and a second closed position. In the first open position, the holes of the base align with the holes of the lid. In the second closed position, the holes of the base do not align with the holes of the lid. A spring means is provided between the base and the lid in order to automatically place the lid in the closed position. Further, the underside of the lid is provided with one or more protrusions which seal the holes of the base when the lid is in the closed position.

6 Claims, 5 Drawing Sheets

SELF-CLOSING POWDER CAP

FIELD OF THE INVENTION

The present invention relates to closures for containers. More particularly, it relates to closures which are self-closing after the consumer is finished dispensing the desired amount of product.

BACKGROUND OF THE INVENTION

Typically, closures for powdered products consist of a lid having one or more holes, through which the product is dispensed. When not in use, the holes in the lid are protected by a cover. Usually, this cover is attached to the lid via a hinge. In order to dispense the product, the consumer removes the cover to expose the holes and then dispenses the product through the holes. This type of container does not normally provide for an airtight seal, without which the product very often has an adverse reaction with the atmosphere outside of the container.

Other powdered product closures comprise a stationary first lid having one or more holes, and a rotatable second lid having one or more holes. By its operation, the consumer rotates the second lid with respect to the first lid until the holes within each are aligned. When the holes are aligned, the consumer dispenses the product. The problem with this style closure is that it is not self-closing. The consumer often forgets to turn the second lid into the closed position after dispensing, thus leaving the container in the open position and making it easy to spill the contents of the container. Also, when the consumer does turn the second lid into the closed position, the amount of turning used by the consumer is often insufficient to properly close the lid, thereby leaving the contents exposed to the atmosphere outside of the container.

French Patent 2645511 discloses a closure for a powdered product which is self-closing. The closure comprises a first lid having at least one orifice, and a second lid slidably disposed about the first lid, the second lid having at least one orifice. By sliding the second lid, the consumer aligns the holes of the first and second lids such that the product can be dispensed. After the consumer has finished dispensing the desired amount of product, a spring between the first lid and the second lid pushes the second lid into the closed position. It is claimed that this structure gives an airtight closure. This, however, is only possible with precise molding of the first lid and the second lid in the area in which the two meet. As shown in the disclosure, the two opposing surfaces which meet have to be perfectly flat. Without this, an airtight seal cannot be made. Because these two surfaces have varying dimensions due to the shapes and sizes of the mold used, the temperature of molding, the quickness and temperature of the cooling process, and the material used to make the parts, obtaining an airtight seal is extremely difficult and costly.

The present invention provides for a closure which is self-closing after the consumer has finished dispensing the desired amount of product.

Also, the present invention provides for a self-closing cap which does not interfere with packaging aesthetics.

Further, the present invention provides for a self-closing cap which is simple and cost effective to manufacture.

SUMMARY OF THE INVENTION

The present invention is a self-closing cap which comprises a base having one or more holes. A lid is movably mounted about the base, said lid having one or more holes, and capable of occupying a first open position and a second closed position. In the first open position, the holes of the base align with the holes of the lid. In the second closed position, the holes of the base do not align with the holes of the lid. A spring means is provided between the base and the lid in order to automatically place the lid in the closed position. Further, the underside of the lid is provided with one or more protrusions which seal the holes of the base when the lid is in the closed position.

BRIEF DESCRIPTION OF THE DRAWINGS

Further objects, features and drawings of the present invention will better be understood in light of the embodiment examples which are discussed below with the aid of a drawing wherein.

DETAILED DESCRIPTION OF THE INVENTION

For purposes of clarity, the present invention will be described as used in conjunction with a powdered or granulated product. This example is merely illustrative, and in no way limits the present invention for use with such products. It will be apparent to one of ordinary skill in the art how the present disclosure can be adapted for use with any type of flowable product, including, but not limited to, lotions, toners, liquid makeup removers, and the like.

Figure 2:
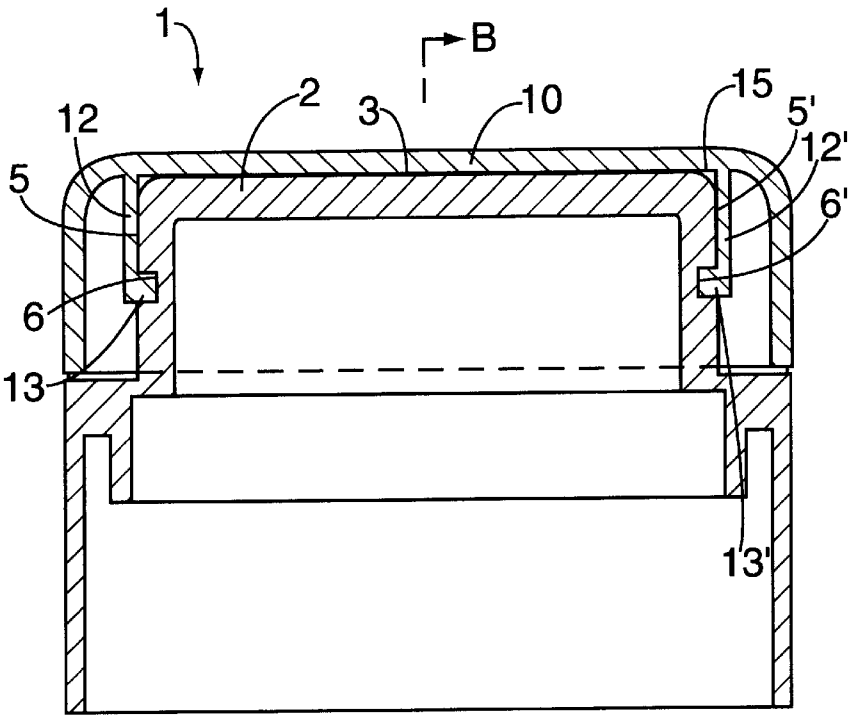
FIG. 2 is a cross-sectional view of the cap of FIG. 1 along line A—A.
Figure 1:
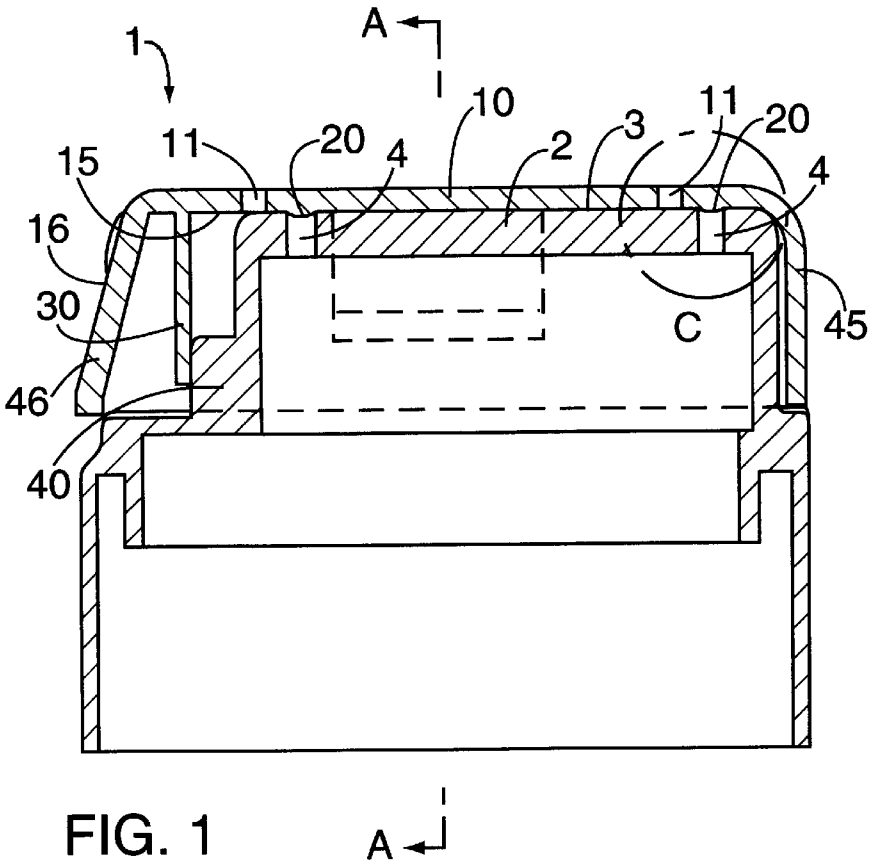
FIG. 1 is a cross-sectional view of the cap of FIG. 2 along line B—B.

Referring now to the drawings, FIGS. 1 and 2 show one embodiment of the self-closing cap 1 of the present invention. The cap 1 comprises a base 2 and a lid 10. The base 2 has an upper surface 3 provided with one or more holes 4. The holes 4 are a size sufficient to allow the product within the container (not shown) to flow out of the container. In other words, if the product is composed of large granular pieces, the holes 4 will have to be larger than the holes needed for a finely powdered product. Preferably, the base 2 has two parallel vertical sidewalls 5 and 5', each sidewall with a horizontal groove 6 and 6'.

A lid 10 is slidably disposed about the base 2, said lid 10 having one or more holes 11. The lid 10 is capable of occupying a first open position, wherein the holes 4 of the base 2 align with the holes 11 of the lid 10, and a second closed position, wherein the holes 4 of the base 2 do not align with the holes 11 of the lid 10. The size of the holes 11 on the lid 10 is comparable to that of the holes 4 on the base 2. This does not mean that the holes on the base and the lid have to be the same size, it just means that the holes, when aligned, provide a passageway of a sufficient size to allow the product within the container to flow out of the container. The lid 10 has vertical wall members 12 and 12' which are parallel to the sidewalls 5 and 5' of the base 2. The wall members 12 and 12' preferably are integrally molded with the lid 10 so as to depend from the underside 15 of the lid 10. Each wall member 12 and 12' has a tongue 13 and 13' which fits within the grooves 6 and 6', respectively, of the base 2 to allow the lid 10 to slide between its open and closed position. Preferably, the wall members 12 and 12' are dimensioned to be slightly flexible in nature so that the lid 10 can be snapped or otherwise assembled onto the base 2.

Figure 3:
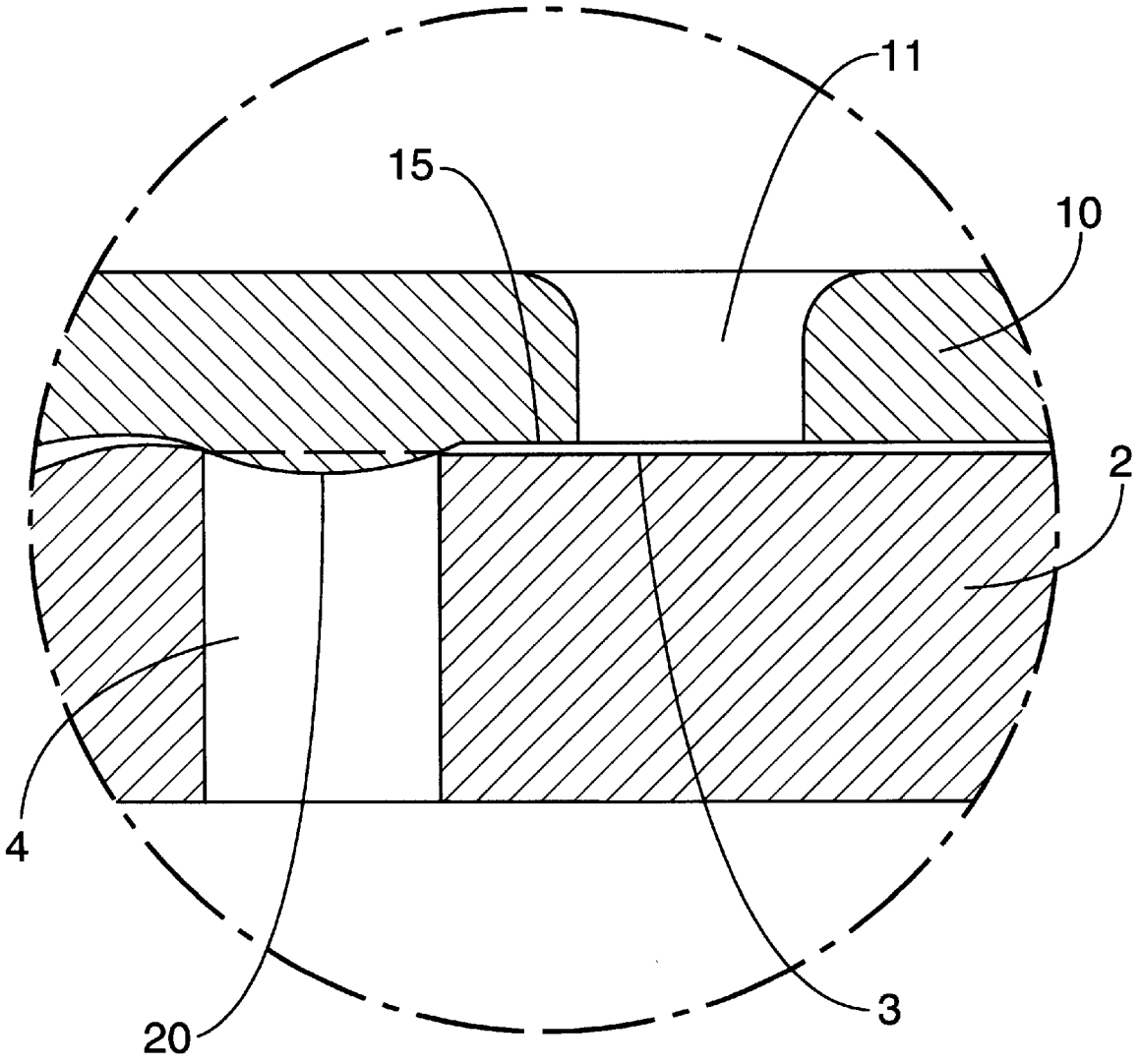
FIG. 3 is a magnified cross-sectional view of detail C of FIG. 1.
Figure 5:
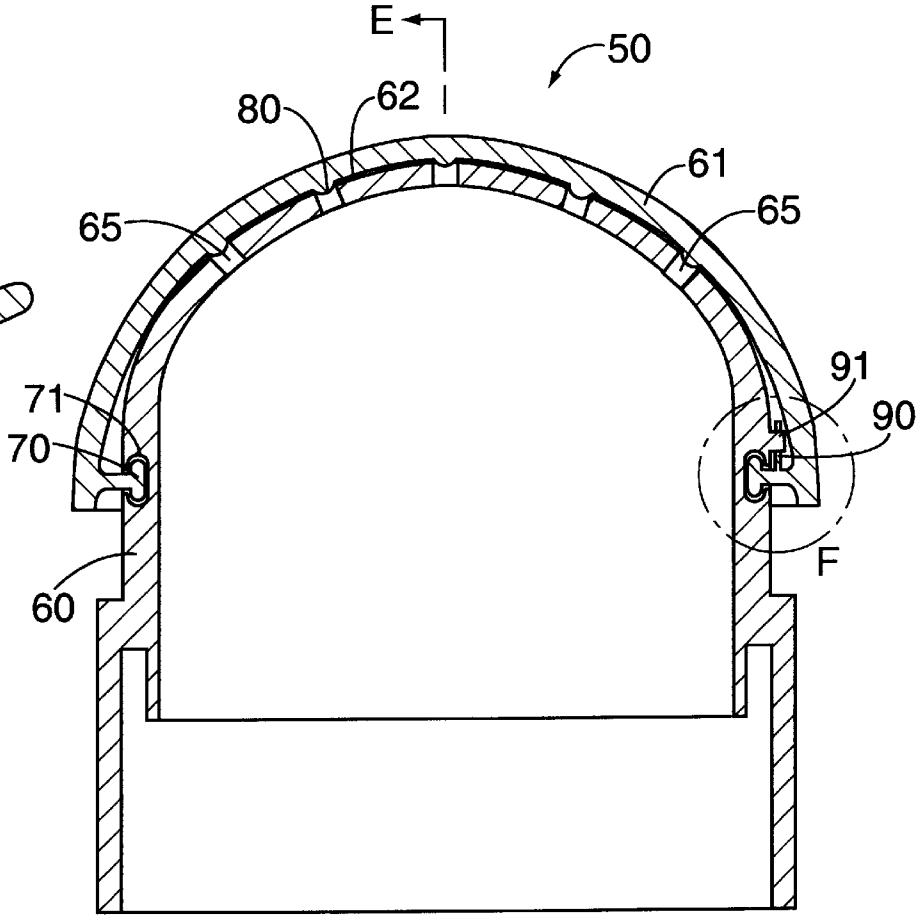
FIG. 5 is a cross-sectional view of the cap of FIG. 4 along line D—D.
Figure 4:
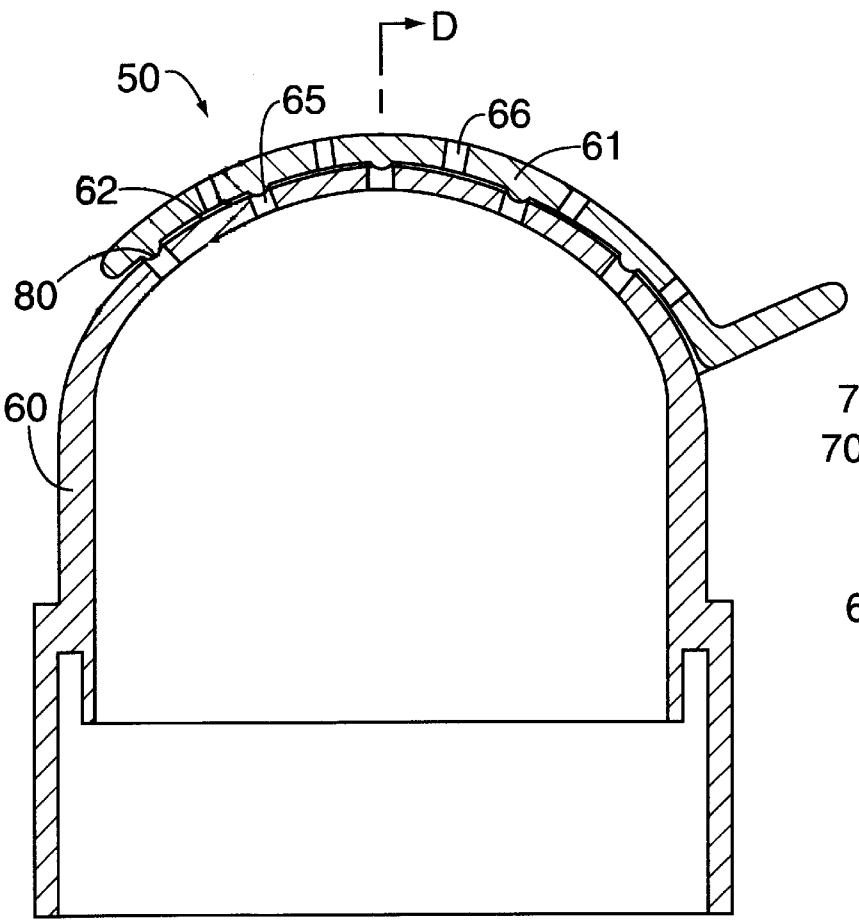
FIG. 4 is a cross-sectional view of the cap of FIG. 5 along line E—E.

One or more protrusions 20 are positioned on the underside 15 of the lid 10 such that the protrusions 20 seal within the holes 4 of the base 2 when the lid 10 is in the closed position, as seen more clearly in FIG. 3. The shape of the protrusions 20 will depend upon the shape of the holes 4. That is, the shape of the protrusion 20 will match the shape of the holes 4 on the base 2, for example, if the holes are oval, the protrusions will be oval. Preferably, the protrusions 20 are rounded, or domed, in shape. The use of rounded protrusions 20 assists in ensuring a seal by providing a better point of contact about the holes 4 of the base 2 when dimensions vary between the lid 10 and the base 2, and between each hole 4 radius. The seal provided by the rounded protrusions 20 is superior to that of two flat surfaces because the rounded surfaces of the protrusions have an increased probability of contacting the entire perimeter of each hole. Preferably, the protrusions 20 are of the same material and integrally molded with the lid 10. However, it is possible to form the protrusions from a different material than that of the lid through the use of bi-injection molding techniques, or by having a separate insert having the protrusions placed on the underside of the lid.

Further, a spring means 30 is provided between the base 2 and the lid 10 for automatically placing the lid 10 in the closed position. The spring means 30 can be either metal or plastic, and can be attached to the base 2 or the lid 10. Preferably, the spring means 30 comprises a resilient plastic strip integrally molded to the underside 15 of the lid 10, and an opposing abutment 40 located on the base 2. The abutment 40 biases the resilient plastic strip 30 into a flexed position as the lid 10 is moved from the closed position into the open position through pressure applied by the consumer to the outer surface 16 of the lid 10. When the pressure is released, the flexed plastic strip pushes against the abutment 40 and returns the lid 10 to the closed position. The spring means 30, however, is not limited to the particular configuration of a resilient plastic strip as described above, and can also be a leaf spring, a coil spring, or any other type of spring which will be capable of forcing the lid 10 into the closed position. The use of the spring means 30 between the base 2 and the lid 10 ensures that the cap 1 cannot be left in the open position, thus ensuring that the product will not be spilled when the container is knocked over.

Preferably, the lid 10 also has a frontwall 45 and a backwall 46, as seen in FIG. 1. The frontwall 45 and backwall 46 preferably meet to form one continuous wall as shown in FIGS. 1 and 2. The frontwall 45 and backwall 46 act as stops for the lid 10 when the lid 10 is moved between the open and the closed position. When the lid 10 is moved into the open position the backwall 46 will eventually contact the base 2, thus limiting the distance that the lid 10 can travel along the base 2, and ensuring that the lid 10 is not easily removed from the base 2. The frontwall 45 acts to stop the lid 10 in the closed position. When the spring means 30 moves the lid 10 into the closed position, the frontwall 45 of the lid 10 contacts the base 2 and stops the lid from moving further, thus ensuring that the spring 30 does not propel the lid 10 off of the base 2 during the return to the closed position.

In an alternate embodiment, as seen in FIGS. 4 to 9, the cap, generally referred to as 50, is dome shaped. The cap 50 comprises a domed base 60 having one or more holes 65. A domed lid 61 having one or more holes 66 is pivotally mounted about the base 60.

Figure 6:
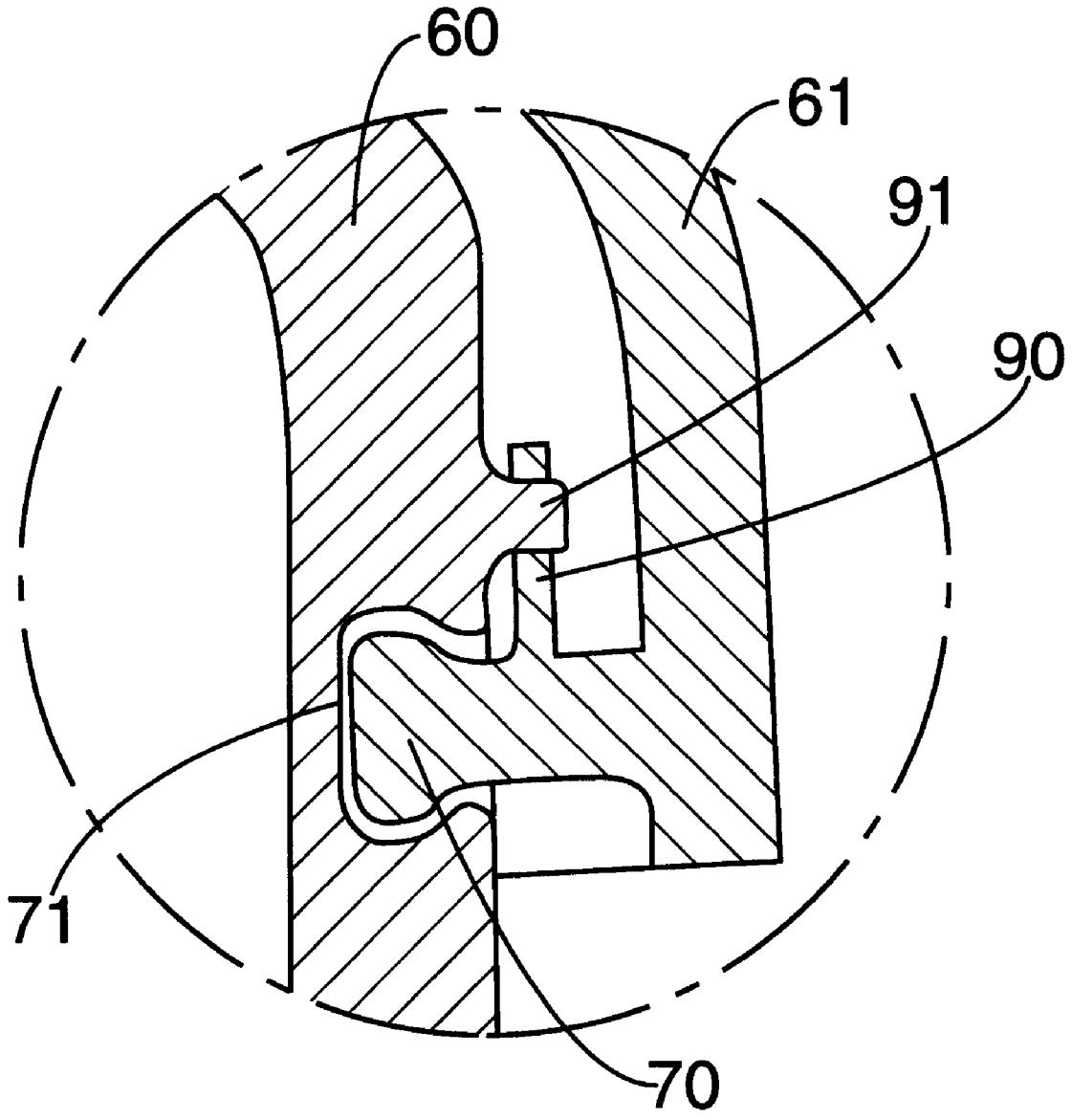
FIG. 6 is a magnified cross-sectional view of detail F of FIG. 4.
Figure 7:
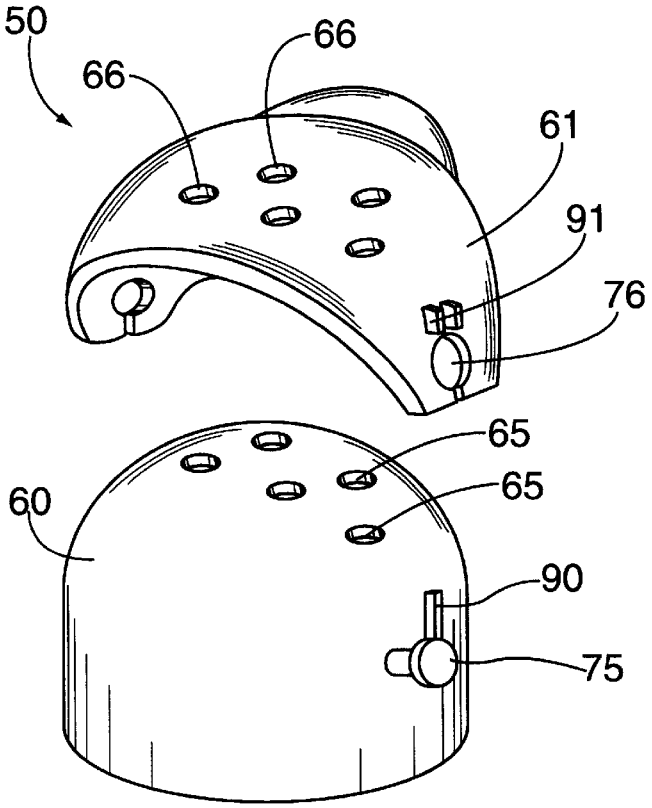
FIG. 7 is an assembly view of a further embodiment of the cap of the present invention.
Figure 9:
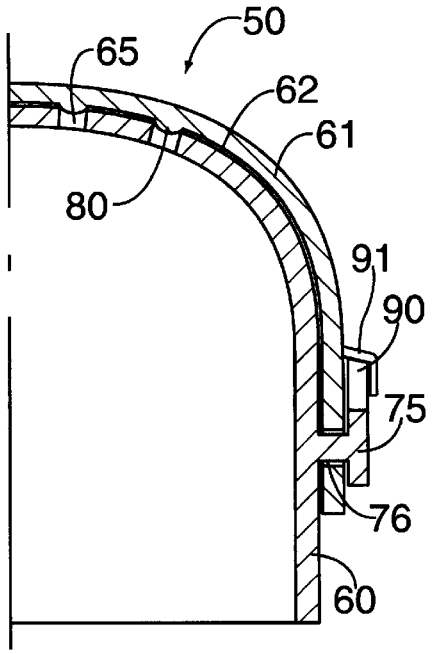
FIG. 9 is a front cross-sectional view of the cap of FIG. 8.
Figure 8:
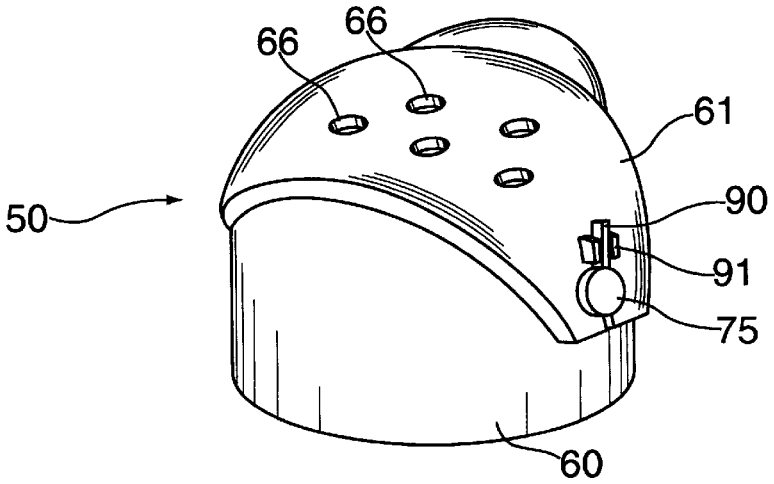
FIG. 8 is a perspective view of the cap of FIG. 7 after assembly.

In order for the lid 61 to pivot about the base 60, the lid 61 can be attached to the base 60 by a ball 70 and socket 71 coupling, as seen more clearly in FIG. 6, wherein the ball 70 is attached to the lid 61 and the socket 71 is within the base 60. Alternatively, as seen in FIGS. 7–9, the lid 61 can be attached to the base 60 by a snap-fitment which allows the lid 61 to pivot. Here, the base 60 is provided with a nub 75 and the lid 61 is provided with an aperture 76 which surrounds the nub 75. The two aforementioned embodiments are merely illustrative of possible alternatives which allow a lid to be pivotally mounted to a base. Various other structures can be used to pivotally mount a lid to a base, those structures being well known and within the scope of the present invention.

With the domed embodiment, the lid 61 pivots between a first open position, where the holes 65 of the base 60 align with the holes 66 of the lid 61; and a second closed position, where the holes 65 of the base 60 do not align with the holes 66 of the lid 61. When in the closed position, protrusions 80 on the underside 62 of the lid 61 seal within the holes 65 of the base 60.

A spring means 90 is provided between the base 60 and the lid 61. Preferably, the spring means 90 comprises a resilient plastic strip, and an opposing abutment 91. The abutment 91 biases the spring 90 into a flexed position as the lid 61 is moved from the closed position into the open position through pressure applied by the consumer to the lid 61. When the pressure is released, the flexed spring 90 pushes against the abutment 91 and returns the lid 61 to the closed position. Depending upon the structure used to pivotally mount the lid 61 to the base 60, the spring means 90 and opposing abutment 91 can each be placed either on the lid 61 or on the base 60. Also, the cap can be provided with one or more spring means, the number of which being dependent upon the amount of pressure required to return the lid to the closed position.

The lid and the base of the present invention are preferably molded of thermoplastic materials, such as polyethylene, polypropylene, styrene, polyvinyl chloride (PVC), polyethylene terephthalate (PET), acrylonitrile-butadiene-styrene (ABS), styrene-acrylonitrile (SAN), or the like.

To operate the cap of the present invention, the consumer applies pressure to the outside of the lid, thus moving the lid into the open position where the holes of the base align with the holes of the lid. The applied pressure must be maintained in order to dispense the product because the action of moving the lid into the open position causes the spring means to flex, making ready to return the lid to the closed position. After the desired amount of product is dispensed, the pressure applied to the lid is released and the spring means automatically returns the lid to the closed position, where the protrusions on the underside of the lid seal within the holes of the base.

What is claimed is:

1. A cosmetic self-closing cap which comprises:

a base having a flat upper surface and a sidewall with an external groove, said upper surface having one or more holes;

a lid, slidably disposed about the base, said lid having one or more holes and a sidewall with an internal tongue, said internal tongue sliding within the groove of the base between a first open position, wherein the holes of the base align with the holes of the lid, and a second closed position, wherein the holes of the base do not align with the holes of the lid;

one or more protrusions positioned on the lid such that the protrusions seal within the holes of the base when the lid is in the closed position; and a spring means positioned between the base and the lid for automatically placing the lid in the closed position, said spring means comprising a resilient plastic strip and an opposing abutment, the resilient plastic strip pushing against the abutment to return the lid to the closed position from the open position.

2. The self-closing cap of claim 1 wherein the protrusions are domed in shape.

3. A cosmetic self-closing cap which comprises:

a domed base having one or more holes;

a domed lid, pivotally mounted to the base, said lid having one or more holes, and capable of occupying a first open position, wherein the holes of the base align with the holes of the lid, and a second closed position, wherein the holes of the base do not align with the holes of the lid;

one or more protrusions positioned on the lid such that the protrusions seal within the holes of the base when the lid is in the closed position; and a spring means positioned between the base and the lid for automatically placing the lid in the closed position, said spring means comprising a resilient plastic strip and an opposing abutment, the resilient plastic strip pushing against the abutment to return the lid to the closed position from the open position.

4. The self-closing cap of claim 3 wherein the lid is pivotally mounted to the base by a ball and socket coupling.

5. The self closing cap of claim 3 wherein the lid is pivotally mounted to the base by a snap-fitment.

6. The self-closing cap of claim 3 wherein the protrusions are domed in shape.

* * * * *